United States Patent [19]

Pronovost

[11] 4,136,523

[45] Jan. 30, 1979

[54] STIRLING TYPE ENGINE AND METHOD FOR OPERATING SAME

[76] Inventor: Jacques O. Pronovost, Guelph, Canada

[21] Appl. No.: 815,709

[22] Filed: Jul. 14, 1977

[51] Int. Cl.[2] ..... F02G 1/02

[52] U.S. Cl. ..... 60/517; 60/650

[58] Field of Search ..... 60/516, 517, 520, 522, 60/525, 526, 650, 682

[56] References Cited

U.S. PATENT DOCUMENTS 1,306,865 6/1919 Stoddard ..... 60/682 X

*Primary Examiner*—Allen M. Ostrager

*Attorney, Agent, or Firm*—Cullen, Sloman, Cantor, Grauer, Scott & Rutherford

[57] ABSTRACT

A Stirling type engine having a cylinder provided with a heated end, containing a displacer plunger, and an opposite end containing a power piston, with a cold space between the plunger and the piston. Normally closed, valved exhaust and inlet ports connect to the cold space. After the usual step of the heated gas from the cylinder heated end portion expanding and driving the displacer plunger and piston and then entering into the cold space, such heated gas is exhausted from the cold space and the cold space is replenished with fresh gas before the next usual step of the piston and plunger moving towards each other for the compression of and the movement of the gas from the cold space into the cylinder heated end portion.

10 Claims, 10 Drawing Figures

STIRLING TYPE ENGINE AND METHOD FOR OPERATING SAME

BACKGROUND OF INVENTION

The invention herein relates to certain improvements to a Stirling type engine, both in construction and in operating method, which improvements are particularly useful for small engines of low horsepower which are adaptable to utilizing either combustion or solar heat energy sources. By way of background, Stirling type engines have been known for over 100 years. In general principal, such engines comprise a cylinder containing a pair of pistons, one forming a displacer plunger or piston and the other forming a power takeoff piston, with a space between the two pistons.

The end of the cylinder at the displacer plunger is heated and either external or internal passages are provided for the movement of gas, i.e., air, between the heated end of the cylinder and the space between the plunger and piston, which space is commonly referred to as the "cold space".

The general operation of that type of engine involves a cycle comprising the steps of: First, the piston and the plunger separated to their maximum, with the cold space between them containing gas, such as air. Second, the piston moves up to compress the gas and to cause it to move into the hot end of the cylinder above the displacer plunger. Simultaneously the displacer plunger moves downwardly towards the piston, providing the space at the hot end of the cylinder to receive the gas from the cold space. Third, the gas, now heated in the heated end of the cylinder, expands and forces both the plunger and piston down for the power stroke of the piston. Lastly, the displacer plunger rises and the gas returns to the cold space. Thereafter the cycle is repeated.

Various timing linkages are provided for timing and controlling the movement of the plunger and the piston and for transmitting the power delivered by the piston. Engines of this type have also been built with multiple cylinders and pistons for increasing the power output.

This type of engine has the advantage of being able to use a variety of different types of fuel to provide the heat energy since the heat is applied to the outside of one end of the cylinder. Thus, a flame type combustion heater may be used utilizing natural or synthetic gases, or petroleum products, or virtually anything that will appropriately burn and provide heat. Moreover, the engine lends itself to being operated by solar heat, i.e., by concentrating the heat of the sun through appropriate mirrors and the like, upon the hot end of the cylinder for providing the necessary heat. Thus, this type of engine is adaptable with respect to the type of fuel used and because the heat is externally provided, substantially complete combustion can be obtained to thereby minimize the exhaust of pollutants into the air. The engine can be made virtually pollution free, particularly if solar operated.

This type of engine lends itself particularly for small horsepower needs, particularly where steady power demands are required as opposed to automotive type of uses where power demands are intermittent and rapid acceleration is required. Although acceleration can be achieved with this type of engine, it becomes relatively complicated to do so.

Although this type of engine has been available since the early Eighteen Hundreds, over the years it has fallen in disfavor and been replaced by internal combustion engines of the 4-cycle, 2-cycle or diesel types and only relatively recently, where engine caused pollution has been a matter of public concern and fuel costs have risen, has interest in this type of engine arisen. However, efforts to utilize this engine have produced relatively complex and expensive constructions.

Thus, the invention herein focuses on a Stirling type of engine which is modified in construction and operation to provide a steady power output at relatively low cost.

SUMMARY OF INVENTION

The invention herein contemplates utilizing the Stirling type engine cycle but with a modification of exhausting the heated gas which returns to the cold space from the heated end of the cylinder and then replacing the heated gas with cooled gas before the compression stroke of the piston. Preferably this is accomplished by using a four stroke type of piston operation with a two stroke type of displacement plunger operation.

That is, the invention herein contemplates utilizing the Stirling cycle movements of moving the power piston into the cold space for compression and transmission of the gas around the displacer plunger and into the hot end of the cylinder. Thereafter, the heated gas rapidly expands, driving the displacer plunger and piston away from the heated end of the cylinder. Next, the displacer plunger returns towards the heated end of the cylinder to open the cold space which receives the now heated gas.

At this point in the cycle, the displacer plunger has risen, i.e., moved back to the heated end of the cylinder, and the piston has moved away from the plunger, with the cold space now containing the heated gas. Then, the plunger remains relatively stationary, while the piston performs another up and down stroke, that is, moves towards the cold space while simultaneously an exhaust port valve is opened to exhaust the gas from the cold space which gas is forced out due to the piston movement. Then, the piston moves away from the cold space, to open it again, and simultaneously an inlet port opens so that a fresh charge of gas is drawn into the cold space. Once the cold space is recharged, the normal Stirling cycle operation proceeds.

An object of this modified operation is to eliminate any contaminates and to avoid buildup of contaminates within the engine cylinder and in addition to operate the engine at a lower temperature. In effect, the cylinder is washed out or cleaned out during each cycle and the fresh recharged gas or air entered into the cold space lowers the temperature differential between the hot and cold spaces for more efficient power output.

The heated exhausted gas can be utilized in providing the combustion heat to the hot cylinder end or alternatively, the heat can simply be discarded either by discharging to atmosphere or by discharging through a closed circuit wherein the gas is cooled.

Another object of the invention herein is to simplify the construction of the engine and to permit usage of conventional engine parts particularly for small engine, low horsepower requirements. By way of example, an existing single cylinder motorcycle engine or lawnmower type of engine can be easily modified for the engine herein. The modification in essence involves omission of the ignition components and the usual head and instead providing a cylinder extension containing a plunger with either a combustion type heater for the cylinder head or an appropriate solar type of device for concentrating solar heat. In addition, a linkage can be added for timing and controlling the plunger. Otherwise, the conventional, existing engine construction which includes the block or housing, cylinder, piston, crankshaft, timing shaft and exhaust and intake valving can all be preserved and utilized. Thus, the overall construction can be substantially reduced in cost because of the ability to use available, high mass production, low cost engine parts to produce the engine herein.

Still another object of the invention herein is to provide a low cost, very simply constructed and operating engine which can operate for long periods of time to produce a relatively low horsepower, without pollution and without noise for such low cost energy needs as continuously operating pumps, battery rechargers and the like.

These and other objects and advantages of this invention will become apparent upon reading the following description, of which the attached drawings form a part.

DETAILED DESCRIPTION

Figure 2:
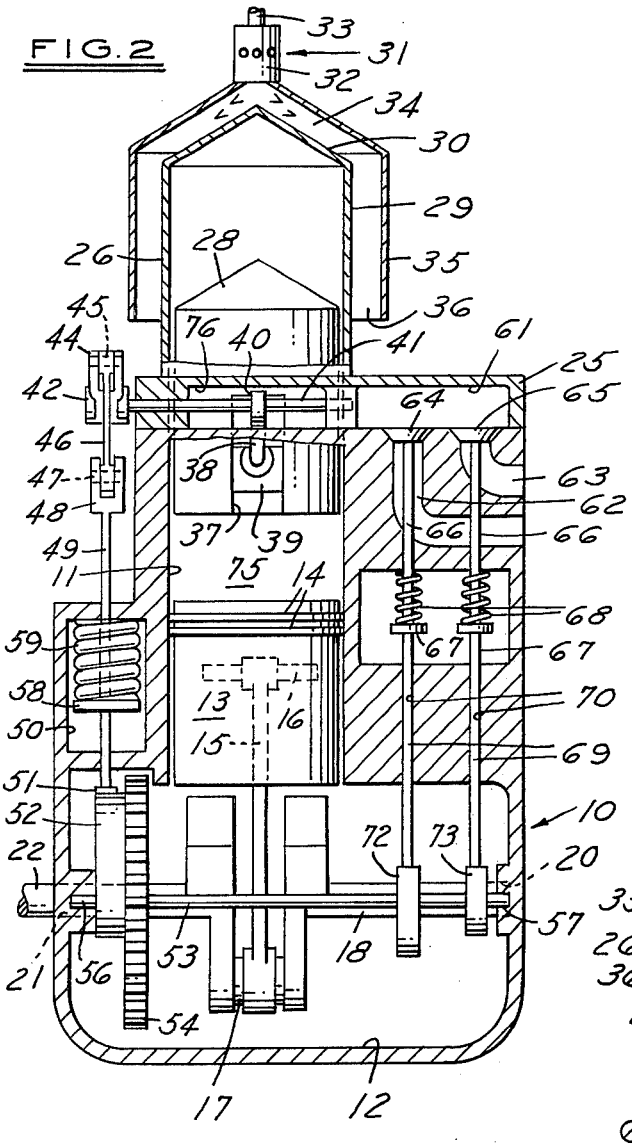
FIG. 2 is a cross sectional front view, also schematically showing the engine parts.
Figure 1:
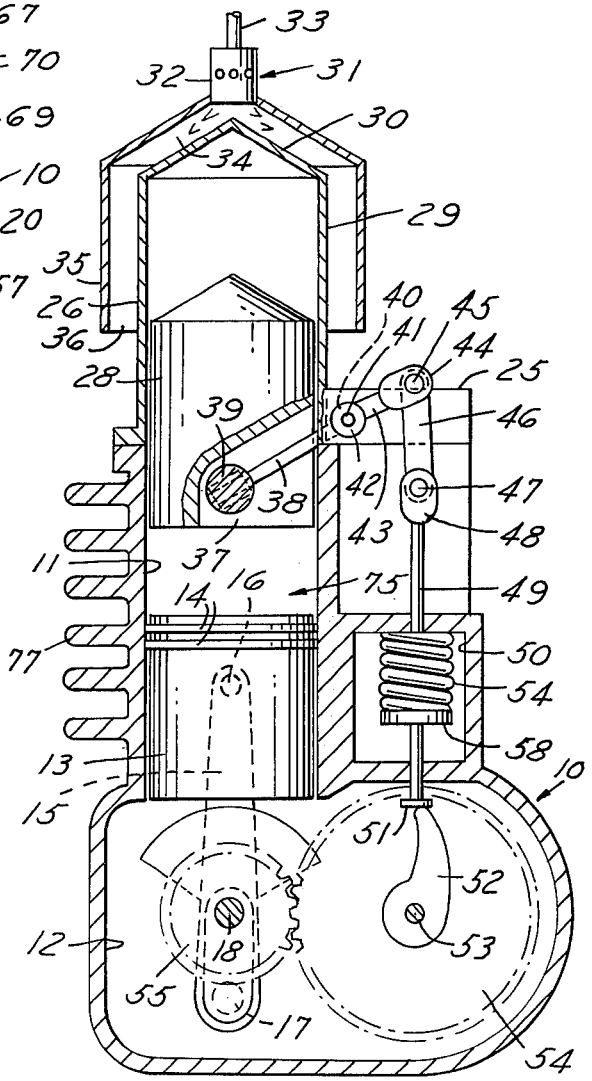
FIG. 1 is a cross sectional side view, schematically showing the engine herein.
Figure 3:
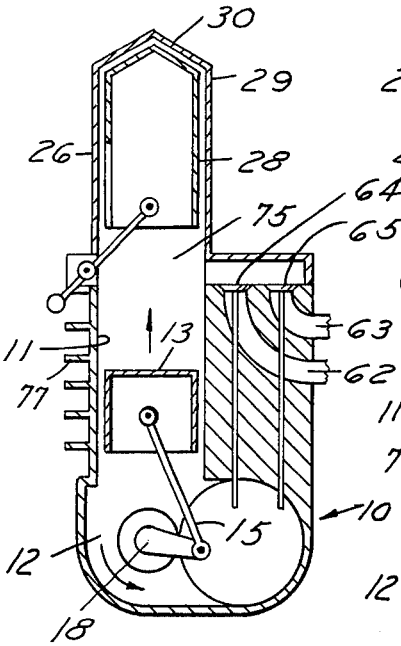
FIGS. 3–8 show successive steps in the cycle of operation of the engine.

Referring to FIGS. 1 and 2 which are cross sectional views of the engine herein, the engine comprises a block or housing 10 having a cylinder 11 and a crankcase 12. A conventional piston 13 having piston rings 14 are mounted within the cylinder for reciprocation.

A piston rod 15 is connected by a rod pin 16 to the piston and by a crankshaft pin 17 to the offset portion of the crankshaft 18. Thus, reciprocal movement of the piston up and down causes rotation of the crankshaft 18.

The crankshaft has its opposite ends mounted within bearings 20 and 21, which are schematically shown, and the free end 22 of the crankshaft extends outwardly of the housing as a power output shaft.

A head 25 is secured to the upper end of the block or housing. A cylinder extension 26 is fastened to the head for extending the length of the engine cylinder. Contained within the cylinder extension is a displacer plunger or piston 28. The plunger is loosely fitted within the cylinder extension, as for example with 1/16th inch clearance all around for a piston of about one and one-half inch in diameter. The gap or spacing between the plunger and the cylinder may be varied for the function to be described below.

The cylinder extension is provided with a hot end portion 29 having a closed end 30 which may be shaped conically or the like for heating purposes.

Above the cylinder end 30 is located a combustion heater 31 having a combustion nozzle 32 for firing a fuel-air mixture supplied through a supply tube 33. Flame and hot products of combustion 34 surround the hot end portion 29 of the cylinder extension due to a containing shroud 35 whose lower end is open to form an annular exhaust space 36 for exhausting the products of combustion to atomsphere.

The displacer plunger is provided with a side slot 37 through which is extended a plunger piston rod 38 connected to the plunger by a slip joint socket 39 for endwise relative movement between the rod and the joint. The opposite end of the rod is connected at 40 to a rotatable rod 41 connected by a boss 42 to a link 43 having a bifurcated end 44. A pin 45 connects a link 46 to such bifurcated end 44.

The link 46 which is approximately vertical as shown in FIG. 1, has its lower end connected by a pin 47 to the bifurcated end 48 of a push rod 49 which extends through a chamber 50 formed in the block or housing 10 and terminates in a lower flat end 51 which engages a cam 52 mounted upon a timing shaft 53. The timing shaft in turn carries a gear 54 which engages a gear 55 mounted upon the crankshaft 18.

The timing shaft 53 is mounted at its opposite ends within suitable bearings or journals 56 and 57 (See FIG. 2).

A ring or washer 58 is fastened to the push rod 49 within the chamber 50 to abut a coil spring 59 whose opposite end is abutted against the upper wall of the chamber 50. The spring thus normally biases the push rod 19 down, against the cam and the cam raises the push rod against the force of the spring 59.

The head 25 is provided with a hollow interior forming a passageway or opening 61 which overlaps an exhaust passage 62 and an inlet passage 63 formed in the block or housing. The exhaust passage is closed by a valve 64 and the inlet passage is closed by a valve 65.

Each of the valves are formed on the end of a valve rod 66 having a lower flat end 67 engaging a coil spring 68 for biasing the valve rods downwardly. The valve rod lower ends rest upon the upper ends of valve push rods 69 which are guided through passageways 70 for engagement at their lower ends with an exhaust timing cam 72 and an inlet timing cam 73 which are mounted upon the timing shaft 53.

Between the bottom face of the displacer plunger and the upper face of the piston is a space 75 within the cylinder 11. This space is referred to as a "cold space" since it is considerably cooler than the hot end of the cylinder extension. The cold space communicates with the exhaust and inlet passages through an opening 76 formed in the interior of the head 25 (See FIG. 2). The cold space itself is cooled by integral fins 77 formed on the housing to enhance cooling to atmosphere.

OPERATION

Figure 4:
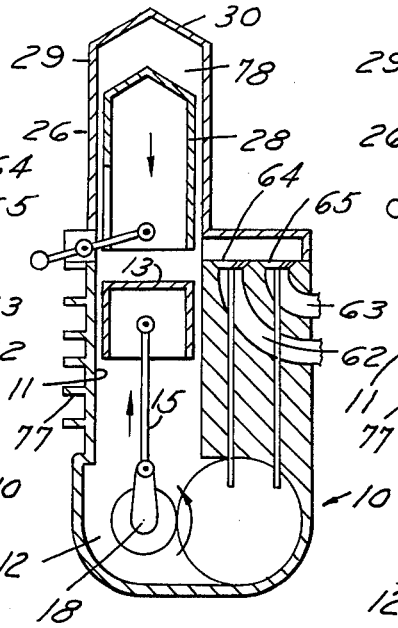
Figure 5:
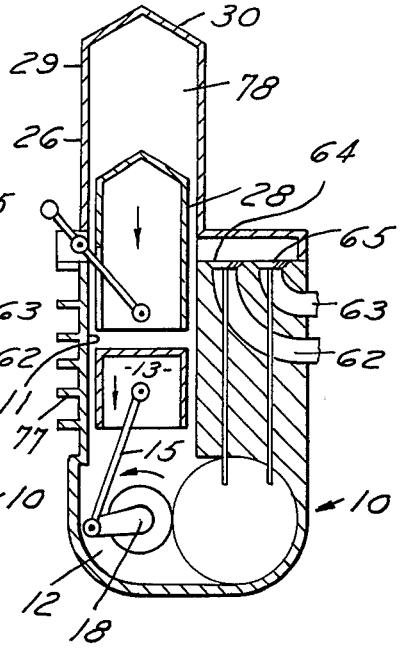

FIGS. 3–8 schematically illustrate various steps in the cycle of operation. Starting with FIG. 3, the cold space 75 is at approximately its maximum, with the power piston moving upwardly to compress the gas, such as atmospheric air, contained within the cold space. The gas is pushed upwardly through the gap or space between the displacer plunger and the cylinder extension so that it enters the hot end portion of the cylinder extension. Meanwhile, as shown in FIG. 4, the displacer plunger begins moving downwardly, leaving a hot end space 78 which fills with the gas transmitted from the cold space. Such gas rapidly heats and rapidly expands, almost explosively, if enough heat is applied to the shaped cylinder end 30 causing rapid downward movement of the displacer plunger and the piston, as shown in FIG. 5. This provides the power stroke of the piston, i.e., the power turning of the crankshaft and the power output portion 22 of the shaft.

Figure 6:
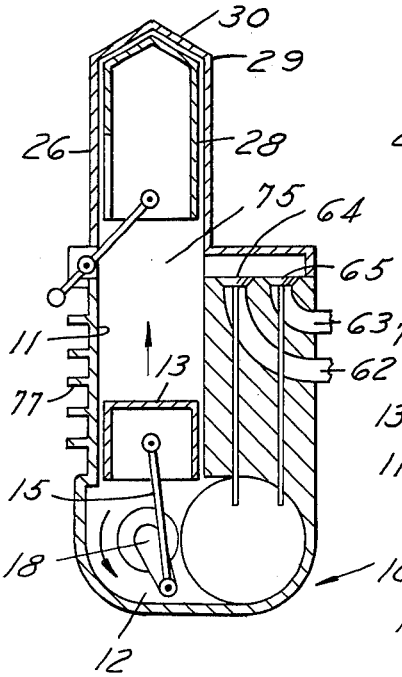
Figure 7:
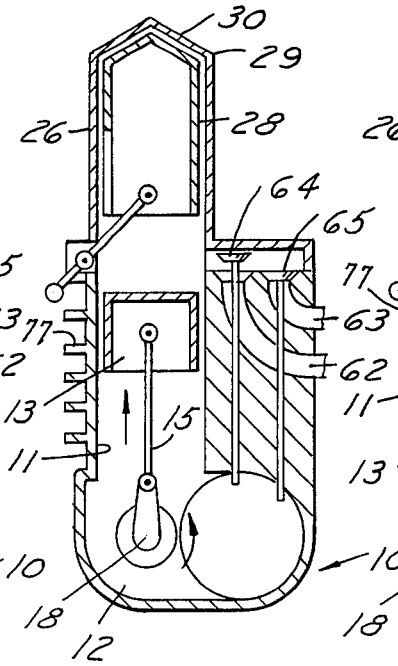

Next, as shown in FIG. 6, the displacer plunger is moved upwardly into the hot end portion of the cylinder extension, thereby opening up the cold space as the piston begins to move upwardly also. At this point, the plunger remains upwardly as the piston travels to its uppermost position as shown in FIG. 7. During the upward movement of the piston, the exhaust valve 64 is opened by the timing cam 73 so that the hot gas contained within the cold space is exhausted. The upward movement of the piston helps the exhaust take place.

Figure 8:
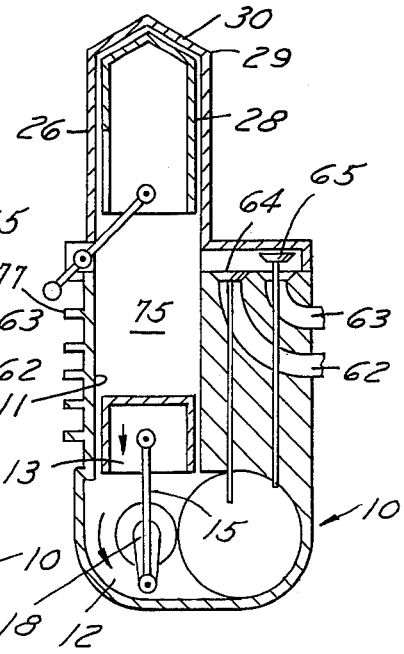

Next, as shown in FIG. 8, the piston moves down, while the displacer plunger remains in its uppermost position, during which time the exhaust valve 64 is closed, but the intake or inlet valve 65 is opened. Thus, fresh gas is drawn into the cold space. For example, fresh atmospheric air could be drawn in. Thereafter, the engine recycles going through the same steps repetitively.

The exhausting and replenishment of the gas from the cold space produces a wash step which not only cleanses the cylinder of impurities, unwanted oil deposits or residues from the crankcase, etc., but also reduces the temperature in the cooling space because of the change from hot to colder gas.

MODIFICATION — FIG. 9

Figure 9:
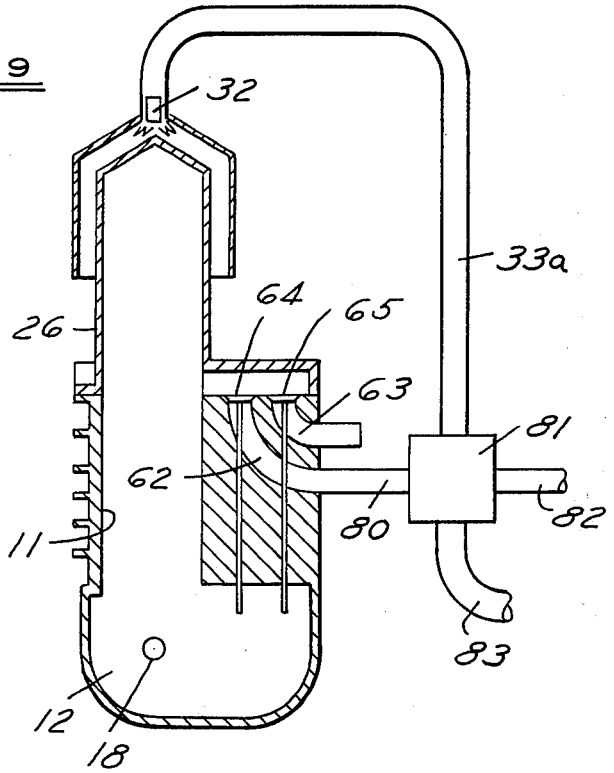
FIG. 9 shows a modification wherein the exhaust gas is utilized for combustion heating.

FIG. 9 shows a modification wherein the gas exhausted from the exhaust passage 62 is transmitted through a tube 80 to a mixing chamber or carburetor 81, shown schematically, into which a fuel inlet pipe 82 is connected and also an additional fresh air supply pipe 83 is connected so that the hot gas, particularly if it is air, coming from the cold space serves to heat up the fuel-air mixture within the mixing chamber or carburetor 81 for transmission through the fuel mixture supply tube 33*a* to the combustion nozzle 32. In that way the heat of the heated gas is not wasted.

MODIFICATION — FIG. 10

Figure 10:
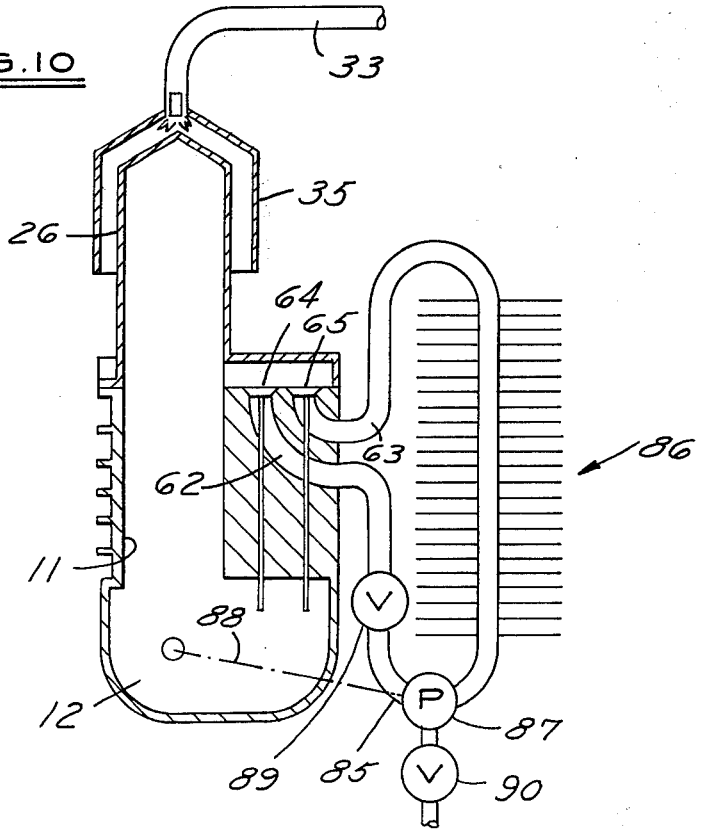
FIG. 10 is a second modification wherein the exhaust gas is flowed through a closed circuit for cooling and for partial replenishment.

FIG. 10 shows a further modification which includes a cooling system formed of a tube 85 extending from the exhaust to the inlet passages for conveying the hot gas through a heat exchanger, schematically shown by the fins 86.

A pump 87 serves to circulate the gas. Such pump is driven from the crankshaft as schematically illustrated by connecting line 88.

A bleed valve 89 in the tube 85 is set to bleed off a small amount of the air or gas passing through the tube on a regular basis. The lost gas is replenished by means of a similar, but oppositely operating bleed-in valve 90 at the pump or otherwise located within the line so that there is a constant loss of a small portion of the gas and a constant replacement of that small portion, in that way ensuring that over a period of time the gas will be replenished with fresh gas, if atmospheric air is used. Alternatively, if the gas is of a non-atmospheric type, such as a gas of a high thermal conductivity, then the bleeder valves may be omitted and the entire eystem kept as a closed circuit.

Having fully described an operative embodiment of this invention, I now claim:

1. In a Stirling cycle type engine having a cylinder provided with a hot end portion containing a displacer plunger and an opposite end portion containing a power piston, with a cold space between the piston and plunger for cyclically causing gas in the cold space to compress and then move into the hot end portion for heating and expansion to thereby drive the plunger and piston away from the hot end portion, and following which the heated gas returns to the cold space, the improvement comprising:

gas exhaust and inlet ports communicating with said cold space, and valve means normally closing said ports, and means for opening the exhaust port valve means for exhausting the heated gas returned to said cold space and thereafter for opening the inlet port valve means for recharging the cold space with gas prior to the compressing of the gas in said cold space.

2. An engine as defined in claim 1, and wherein said gas exhaust port opens to atmosphere for atmospheric discharge of the gas passing therethrough, and wherein the gas entering the inlet port is fresh atmospheric gas.

3. An engine as defined in claim 1, and including a closed tubing system carrying the gas from the exhaust port back to the inlet port through a cooling means for cooling said gas;

and means for continuously bleeding off and thus discharging, a small portion of the gas passing through the tubing system, and means for adding fresh gas to the tubing system for continuously replacing the bled-off gas.

4. An engine as defined in claim 1, and including a combustion type heater for heating the external surface of the cylinder hot end portion, and a tubing system for carrying the gas exhausted from said exhaust port to said heater for utilizing the heated gas for combustion.

5. An engine as defined in claim 1, and including said plunger being gapped from the adjacent cylinder wall a sufficient distance for movement of the gas between the hot end portion and the cold space around the displacer plunger.

6. In a method for operating a Stirling cycle type engine having a cylinder with a hot end portion containing a reciprocable displacer plunger and with a drive end portion containing a power piston with a cold space located between the plunger and piston, the cycle generally including the steps of moving the piston into the cold space for compressing gas contained therein, moving the gas into the cylinder hot end portion for heating the gas, expanding the gas for thereby moving the plunger and the piston away from the hot end portion of the cylinder towards the drive end portion for providing piston power, and then moving the plunger back towards the cylinder hot end portion for transferring the heated gas into the cold space, the improvement comprising:

first, exhausting the heated gas from the cold space and thereafter, recharging the cold air space with fresh cold gas, and then repeating the above described cycle.

7. In a method as defined in claim 6 above, and including the step of moving the piston towards the plunger during the exhausting of the heated gas from the cold space and moving the piston away from the plunger during the recharging of the cold air space with fresh gas while holding the plunger substantially stationary during such piston movement.

8. In a method as defined in claim 6, and including the steps of moving the heated gas exhausting through the exhaust port through a closed cooling system for cooling such gas, and then moving the gas back into the inlet port, and bleeding off a small proportion of the gas from the cold space and replacing such bled-off gas with fresh gas.

9. In a method as defined in claim 6, and including the steps of combusting the heated exhaust gas to provide heat to the cylinder heated end.

10. A method of making an externally heated, Stirling cycle type engine comprising the steps of:

beginning with a conventional, small size, 4-cycle engine construction having a cylinder, with a housing block, a crankcase, and a crankshaft within the crankcase connected to a power piston arranged within the cylinder for reciprocation therein, and valved inlet and exhaust ports opening into the cylinder above the piston, i.e., remote from the crankshaft;

adding an extension cylinder to the first mentioned cylinder in place of the conventional cylinder head, and providing a displacer plunger within the extension cylinder to form a cold space between the plunger and piston, with the inlet and outlet ports communicating with said cold space;

providing means for heating the end portion of the extension cylinder which is remote from the cold space;

and providing timing means operably timed to the piston for timing the reciprocating movement of the plunger relative to the piston;

whereby the engine operates according to a modified Stirling cycle including the normal cycle steps of the plunger and piston moving towards and away from each other with the gas moving from the cold space to the hot end portion of the extension cylinder and back, but with the addition of the heated gas, upon entering the cold space from the extension cylinder hot end portion, being exhausted and replenished by fresh gas during which time the plunger remains stationary and the piston moves toward the plunger for the exhaust and away from the plunger for the replenishing of the gas.

* * * * *